US009407019B2

(12) United States Patent
Falk

(10) Patent No.: US 9,407,019 B2
(45) Date of Patent: Aug. 2, 2016

(54) CONNECTION MODULE

(71) Applicant: PHOENIX CONTACT GMBH & CO.KG, Blomberg (DE)

(72) Inventor: Detlev Falk, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/419,656

(22) PCT Filed: Jul. 16, 2013

(86) PCT No.: PCT/EP2013/064998
§ 371 (c)(1),
(2) Date: Feb. 5, 2015

(87) PCT Pub. No.: WO2014/023532
PCT Pub. Date: Feb. 13, 2014

(65) Prior Publication Data

US 2015/0229045 A1 Aug. 13, 2015

(30) Foreign Application Priority Data

Aug. 8, 2012 (DE) ..... 10 2012 107 264

(51) Int. Cl.
*H01R 9/26* (2006.01)

(52) U.S. Cl.
CPC ..... *H01R 9/26* (2013.01); *H01R 9/2608* (2013.01); *H01R 9/2675* (2013.01)

(58) Field of Classification Search
CPC ..... H01R 9/2608; H01R 9/26; H01R 9/2625; H01R 9/2633; H01R 9/2641; H01R 9/265; H01R 9/2658; H01R 9/2666; H01R 9/2675; H01R 9/2691
See application file for complete search history.

(56) References Cited

U.S. PATENT DOCUMENTS 5,658,172 A * 8/1997 Schmidt ..... H01R 31/02 439/709
5,669,788 A * 9/1997 Brockman ..... H01R 9/2675 439/511
6,425,770 B1 * 7/2002 Lostoski ..... H01R 9/26 361/759
6,506,071 B2 * 1/2003 Lange ..... H01R 9/26 439/358
7,192,316 B1 * 3/2007 Pollmann ..... H01R 9/2675 439/716
7,537,496 B2 * 5/2009 Bentler ..... H01R 9/2491 439/532

(Continued)

FOREIGN PATENT DOCUMENTS

DE 134416 A1 2/1979
DE 4034204 A1 4/1992

(Continued)

*Primary Examiner* — Ross Gushi
(74) *Attorney, Agent, or Firm* — Leydig, Voit & Mayer, Ltd.

(57) ABSTRACT

A connection module includes a housing having a housing base and a housing upper surface. The housing is configured to fix to a mounting rail via the housing base via a pivoting movement of the housing. The connection module includes a plurality of connection elements arranged in the housing, and at least one jumper insertion opening for receiving a jumper. The jumper is disposed in a transverse side of the housing. The connection module includes a contact element for forming an electrical contact with the jumper. The contact element is arranged in the jumper insertion opening. The jumper insertion opening extends in the direction of insertion of the jumper into the jumper insertion opening from the housing base towards the housing upper surface at an angle α of between 20 and 70 degrees to a transverse axis of the housing.

4 Claims, 1 Drawing Sheet

(56) References Cited

U.S. PATENT DOCUMENTS 7,666,037 B2 * 2/2010 Diessel ..... H01R 9/2616 439/716
7,695,324 B2 * 4/2010 Diekmann ..... H01R 9/2633 439/721
7,753,739 B2 * 7/2010 Bentler ..... H01R 9/2491 439/532
7,862,389 B2 * 1/2011 Pizzi ..... H01R 4/28 439/709
8,128,430 B2 * 3/2012 Diessel ..... H01R 31/085 439/507
8,206,164 B2 * 6/2012 Sprenger ..... H01R 9/2625 439/153
8,460,038 B2 * 6/2013 Eisert ..... H01R 9/2625 439/716
8,581,131 B2 * 11/2013 Pollmann ..... H01H 1/365 200/244
8,647,157 B2 * 2/2014 Gan ..... H01H 50/048 439/507
8,651,902 B2 * 2/2014 Wu ..... H01R 4/363 439/709
8,715,017 B1 * 5/2014 Barber ..... H01R 9/2408 439/716
8,771,007 B2 * 7/2014 Reibke et al. ..... H01R 31/085 439/189
8,911,267 B2 * 12/2014 Pizzi ..... H05K 5/0069 439/716
8,961,208 B2 * 2/2015 Bentler et al. ..... H01R 9/26 439/188
9,039,460 B2 * 5/2015 Hackemack et al. .... H01R 9/16 439/716
9,118,124 B2 * 8/2015 Buettner et al. ..... H02B 1/052
2001/0034165 A1 * 10/2001 Landis ..... H01R 13/6658 439/716
2011/0014808 A1 * 1/2011 Diessel ..... H01R 9/2675 439/296
2011/0059658 A1 * 3/2011 Eisert ..... H01R 9/2625 439/716
2011/0177724 A1 * 7/2011 Pizzi ..... H01R 9/265 439/716
2012/0149237 A1 * 6/2012 Gan ..... H01R 50/048 439/507
2012/0252262 A1 * 10/2012 Reibke ..... H01R 31/085 439/507
2012/0329315 A1 12/2012 Hanses
2013/0034991 A1 2/2013 Hanses et al.
2013/0133716 A1 * 5/2013 Buettner ..... H01R 25/142 136/244
2013/0280934 A1 * 10/2013 Buettner ..... H02B 1/052 439/153
2014/0077832 A1 * 3/2014 Hackemack ..... G01R 1/0416 324/755.05
2015/0147907 A1 * 5/2015 Goerlitzer et al. ... H01R 9/2625 439/512
2015/0229045 A1 * 8/2015 Falk ..... H01R 9/2608 439/121

FOREIGN PATENT DOCUMENTS

DE 19531115 A1 2/1997
DE 29914020 U1 12/2000
DE 10330085 A1 2/2004
DE 202007004414 U1 5/2007
DE 102008012580 A1 9/2008
DE 102010009807 A1 9/2011
DE 102010016865 A1 11/2011
EP 0155905 A2 9/1985
EP 0327385 A1 8/1989
EP 1258957 A1 11/2002
EP 2503644 A1 9/2012
FR 2859317 A1 3/2005
WO WO2011/048151 * 4/2011
WO WO 2011107457 A1 9/2011

* cited by examiner

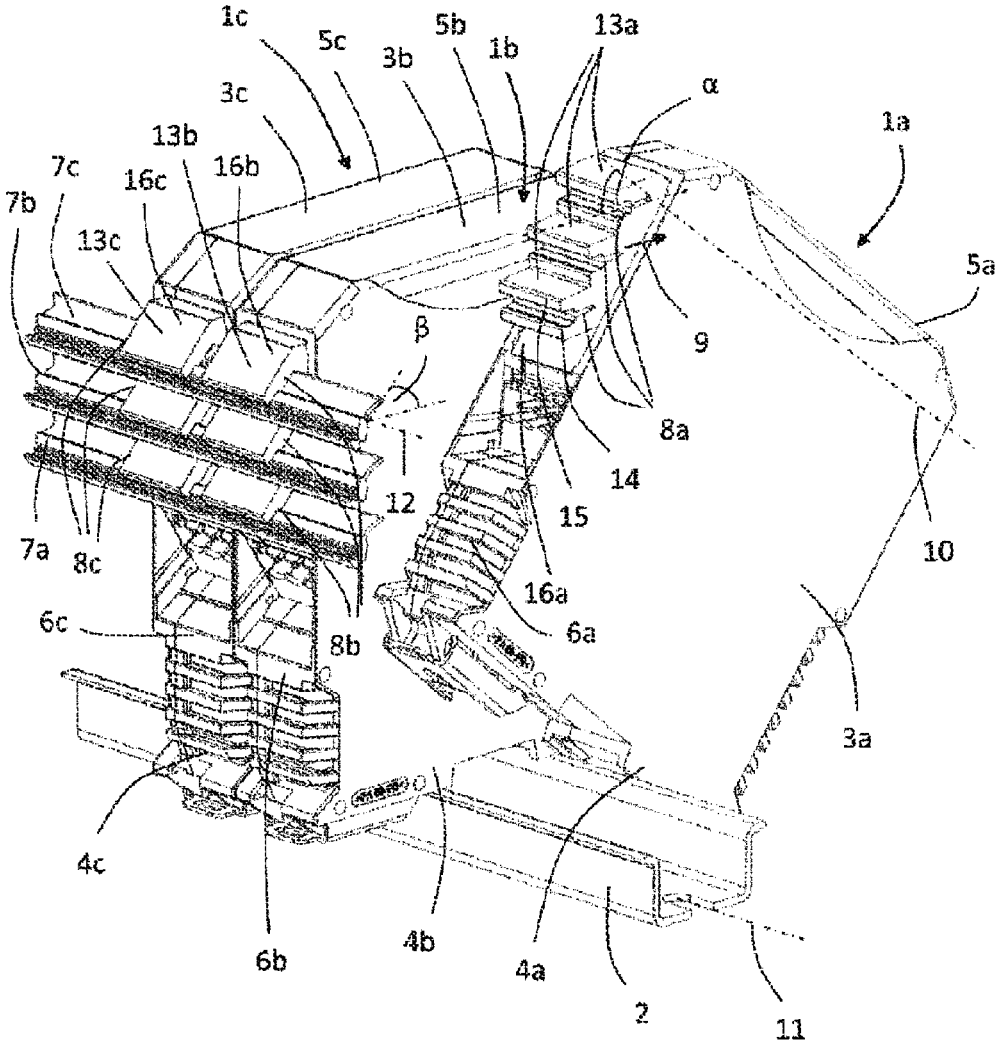
1c
5c
3b
5b
1b
13a
α
1a
3c
13b
7c
16c
16b
7b
13c
5a
β
9
8a
14
12
15
7a
8c
10
16a
6c
8b
6a
3a
4c
6b
4b
4a
2
11

CONNECTION MODULE

CROSS-REFERENCE TO RELATED APPLICATIONS

This application is a U.S. National Phase application under 35 U.S.C. §371 of International Application No. PCT/EP2013/064998, filed on Jul. 16, 2013, and claims benefit to German Patent Application No. DE 10 2012 107 264.7, filed on Aug. 8, 2012. The International Application was published in German on Feb. 13, 2014, as WO 2014/023532 A1 under PCT Article 21 (2).

FIELD

The invention relates to a connection module, comprising a housing having a housing base and a housing upper surface, the housing being capable of being fixed to a mounting rail via the housing base by means of a pivoting movement of the housing, a plurality of connection elements which are arranged in the housing, and at least one jumper insertion opening, for receiving a jumper, which is arranged in a transverse side of the housing, a contact element, for forming an electrical contact with the jumper, being arranged in the jumper insertion opening.

BACKGROUND

A connection module of this type is usually disc shaped, it being possible for a plurality of connection modules to be arranged in series on a mounting rail in order to form a connection module unit. Jumpers or bus systems can be used to interconnect the individual connection modules.

A bus system is usually fixed to the mounting rail in such a way that the housing of the connection module is connected to the mounting rail and the bus system via the housing base. A drawback of mounting rail bus systems of this type is the low current-carrying capacity, which is at most 8 A, making it insufficient for some applications.

When using bus systems in the form of jumpers that each extend over a plurality of connection modules which are arranged in series, it is known, for example from WO 2011/107457 A1, to fix said connection modules to a transverse side of the housing rather than to the housing base. When assembling a connection module unit of this type, the individual connection modules are firstly snapped onto the mounting rail, and then one or more jumpers are snapped into the connection modules on the mounting rail. To disassemble the connection module unit, the jumpers have to be removed first, before individual connection modules can be detached from the mounting rail, thereby leading to laborious and time-consuming handling.

SUMMARY

In an embodiment, the present invention provides a connection module comprising a housing having a housing base and a housing upper surface. The housing is configured to fix to a mounting rail via the housing base via a pivoting movement of the housing. The connection module includes a plurality of connection elements disposed in the housing, and at least one jumper insertion opening for receiving a jumper. The at least one jumper insertion opening is disposed in a transverse side of the housing. The connection module includes a contact element for forming an electrical contact with the jumper. The contact element is disposed in the jumper insertion opening. The jumper insertion opening extends in the direction of insertion of the jumper into the jumper insertion opening from the housing base towards the housing upper surface at an angle α of between 20 and 70 degrees to a transverse axis of the housing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 1 shows three connection modules arranged side by side on a mounting rail in accordance with the present invention.

DETAILED DESCRIPTION

An aspect of the invention provides a connection module in which the handling when fixing the connection module to a mounting rail and to a jumper, and when detaching the connection module from a mounting rail and from a jumper, is improved.

In a connection module of the type described in greater detail at the outset, aspect in an embodiment of the invention the jumper insertion opening extends in the direction of insertion of the jumper into the jumper insertion opening from the housing base towards the housing upper surface at an angle α of between 20 and 70° to the transverse axis of the housing.

According to an embodiment of the invention, the jumper insertion opening extends, from the start to the end thereof, where the jumper rests when inserted, from the bottom up, i.e. from the housing base towards the housing upper surface, in such a way that the jumper insertion opening is oriented at an angle to the transverse axis of the housing. In this arrangement, the angle α of the jumper insertion opening to the transverse axis of the housing is between 20 and 70°, preferably between 30 and 60° and more preferably 45°. The angle α is dependent on the pivoting movement of the housing of the connection module on the mounting rail and on the position of the jumper relative to the housing. When the connection module pivots laterally on the mounting rail, this angle α makes it possible for the jumper insertion opening of the connection module to be connected to the jumper arranged to the side of the mounting rail by inserting the jumper into the jumper insertion opening, and to be disconnected again. A connection module which is arranged centrally between two connection modules can thus be disconnected from the mounting rail and from the jumper without the connection modules which are arranged adjacent thereto also having to be detached from the mounting rail. It is also thus possible to fix a connection module between two connection modules which are already arranged on the mounting rail without detaching the adjacent connection modules, by pivoting the connection module to be fixed to the mounting rail and by hooking or latching the connection module onto both the mounting rail and the jumper. The jumper is preferably in the form of an elongate rail, the length of said rail being able to be adapted to the number of connection modules which are arranged in series and combined to form a unit. In this case, a connection module unit comprises a plurality of connection modules, at least one jumper and a mounting rail. The simplified process of fixing and replacing a connection module in a connection module unit brought about by the connection module according to the invention makes it substantially easier and thus quicker for the user to handle a connection module and thus a connection module unit.

According to a preferred embodiment of the invention, the jumper insertion opening is arranged in an upper region of the transverse side of the housing, which region is arranged so as to be adjacent to the housing upper surface. This makes it possible for the jumper insertion opening to be positioned particularly advantageously relative to the centre of rotation of the connection module on the mounting rail, to make it as easy as possible for the connection module to be disconnected and fixed via the jumper insertion opening to a jumper which is in a fixed position.

The jumper insertion opening is preferably formed in a module insert, the module insert being inserted into an opening which is formed in the transverse side of the housing. The module insert is formed as a separate component to the housing of the connection module and to the two housing halves, which are assembled to form the housing of the connection module, and said insert can therefore be separated from the housing and the two housing halves. When the connection module is being assembled and before the two housing halves are assembled to form a housing, the module insert is inserted into a first recess formed in a first housing half, said recess forming, together with a second recess formed in a second housing half, the opening in the transverse side of the housing when the two housing halves are assembled. The module insert comprises one or more jumper insertion openings as well as the contact elements which are arranged in the jumper insertion openings. When inserted, the module insert is preferably flush with the transverse side of the housing. Since the module insert is easy to replace, a suitable module insert, which has a number of jumper insertion openings which is adapted to the number of jumpers, can be selected according to the number of jumpers. If, moreover, the contact element which is arranged in the jumper insertion opening is no longer operational, the module insert can be replaced quickly, easily and cost-effectively without the entire connection module having to be replaced. The module insert can be detachably fixed, for example by means of a snap-on connection, in the opening in the transverse side of the housing or in the recesses in the two housing halves forming the opening. As an alternative to the module insert, it is, however, also possible to form the jumper insertion opening directly in the transverse side of the housing so that it is part of the housing or the housing halves.

Furthermore, it is preferably provided that the jumper insertion opening is arranged in a retaining element protruding from the transverse side of the housing, said element preferably being U-shaped. The protrusion of the retaining element from the transverse side of the housing prevents the jumper insertion opening from taking up any of the installation space inside the housing. The preferably U-shaped retaining element has two retaining arms which are arranged parallel to each other, between which the jumper insertion opening is formed in such a way that a jumper inserted into the jumper insertion opening is retained between the two retaining arms. The contact element, which is preferably also U-shaped, is also arranged between these two retaining arms in such a way that it rests directly on the retaining arms and can thus be retained by the retaining arms. The retaining element can either be formed on a module insert or can be formed directly on the transverse side of the housing, in which case it is formed integrally with the housing.

The invention is described in greater detail below on the basis of a preferred embodiment with reference to the accompanying drawing.

FIG. 1 shows three connection modules 1*a*, 1*b*, 1*c* which are arranged side by side, two of the connection modules 1*b*, 1*c* being fixed to a mounting rail 2 and the third connection module 1*a* being shown in a position in which it is being pivoted on the mounting rail 2 so that it can be disconnected or fixed. The connection modules 1*a*, 1*b*, 1*c* are disc shaped and have a substantially rectangular housing 3*a*, 3*b*, 3*c*. The housings 3*a*, 3*b*, 3*c* are each formed of two housing halves. A plurality of connection elements are arranged inside the housing 3*a*, 3*b*, 3*c*. The housings 3*a*, 3*b*, 3*c* each have a housing base 4*a*, 4*b*, 4*c* and a housing upper surface 5*a*, 5*b*, 5*c* which is formed opposite the housing base 4*a*, 4*b*, 4*c*, the housing 3*a*, 3*b*, 3*c* being capable of being fixed to the mounting rail 2 by means of the housing base 4*a*, 4*b*, 4*c*.

On a transverse side 6*a*, 6*b*, 6*c* of the housing 3*a*, 3*b*, 3*c* extending between the housing base 4*a*, 4*b*, 4*c* and the housing upper surface 5*a*, 5*b*, 5*c*, the connection modules 1*a*, 1*b*, 1*c* are connected to three jumpers 7*a*, 7*b*, 7*c*, respectively, which are fixed in position relative to the mounting rail 2. The connection is produced by means of jumper insertion openings 8*a*, 8*b*, 8*c* which are formed in the transverse side 6*a*, 6*b*, 6*c* of the housing 3*a*, 3*b*, 3*c*, the connection modules 1*a*, 1*b*, 1*c* in this case having three jumper insertion openings 8*a*, 8*b*, 8*c*, respectively, which are arranged one on top of the other. A contact element for forming an electrical contact with the jumper 7*a*, 7*b*, 7*c* is arranged inside each jumper insertion opening 8*a*, 8*b*, 8*c*. The contact elements are connected to the connection elements which are arranged in the housing 3*a*, 3*b*, 3*c*, more particularly to the bus bars which are arranged in the connection elements. The contact elements are preferably in the form of U-shaped contact terminals, which the jumpers 7*a*, 7*b*, 7*c* can encompass on one of the edges thereof to form an electrical contact.

The jumpers 7*a*, 7*b*, 7*c* are each in the form of a rail, more particularly a copper rail, and are used to supply current to the connection modules, more particularly to the bus bars inside the connection modules, it being possible in this case to transmit a current of up to 40 A. The length of the jumpers 7*a*, 7*b*, 7*c* can be adapted by reducing the number of connection modules 1*a*, 1*b*, 1*c* to be bridged. The jumpers 7*a*, 7*b*, 7*c* are each oriented with the longitudinal axis thereof running parallel to the longitudinal axis of the mounting rail 2 and are laterally offset with respect to the mounting rail 2 and arranged above the mounting rail 2.

The jumpers 7*a*, 7*b*, 7*c*, which instead of being arranged in a straight line to the longitudinal axis 11 of the mounting rail 2 are arranged at a tilt to the longitudinal axis 11 of the mounting rail 2 with an angle of inclination $\beta>0°$ with respect to their own longitudinal axis 12, are inserted into the corresponding jumper insertion openings 8*a*, 8*b*, 8*c* in the connection modules 1*a*, 1*b*, 1*c* by a pivoting movement of the connection modules 1*a*, 1*b*, 1*c* on the mounting rail 2 towards the jumpers 7*a*, 7*b*, 7*c*, in order to form a contact with the connection modules 1*a*, 1*b*, 1*c*. In doing so, the jumper insertion openings 8*a*, 8*b*, 8*c* extend in the direction of insertion (indicated by the arrow 9) of the jumpers 7*a*, 7*b*, 7*c* into the jumper insertion openings 8*a*, 8*b*, 8*c* from the housing base 4*a*, 4*b*, 4*c* towards the housing upper surface 5*a*, 5*b*, 5*c* at an angle $\alpha$ of between 20 and 70°, preferably of 45°, to the transverse axis 10 of the housing 3*a*, 3*b*, 3*c*, shown here by the first connection module 1*a*. The angle $\alpha$ of the jumper insertion opening 8*a*, 8*b*, 8*c* is, in this case, adapted to the angle of inclination $\beta$ of the jumper 7*a*, 7*b*, 7*c*, the angle $\alpha$ preferably corresponding to the angle of inclination $\beta$, in order to make it possible for the jumpers 7*a*, 7*b*, 7*c* to be inserted easily and uniformly into the respective jumper insertion openings 8*a*, 8*b*, 8*c* when the housing 3*a*, 3*b*, 3*c* of the connection module 1*a*, 1*b*, 1*c* is pivoted on the mounting rail 2.

Here, the jumper insertion openings 8*a*, 8*b*, 8*c* are arranged in an upper region of the transverse side 6*a*, 6*b*, 6*c* of the housing 3*a*, 3*b*, 3*c* which is arranged so as to be adjacent to the housing upper surface 5*a*, 5*c*, 5*d*.

In the embodiment shown here, the jumper insertion openings 8*a*, 8*b*, 8*c* are formed in U-shaped retaining elements 13*a*, 13*b*, 13*c*, which are formed on the transverse side 6*a*, 6*b*, 6*c* of the housing 3*a*, 3*b*, 3*c* and protrude therefrom, as a result of being pointed away from the housing 3*a*, 3*b*, 3*c*. The jumper insertion openings 8*a*, 8*b*, 8*c* thus do not extend into the housing halves of the housing 3*a*, 3*b*, 3*c*.

The U-shaped retaining elements 13*a*, 13*b*, 13*c* each comprise two retaining arms 14, 15 which are arranged parallel to each other, between which a jumper insertion opening 8*a*, 8*b*, 8*c* is formed in each case, in such a way that a jumper 7*a*, 7*b*, 7*c* which is inserted into the jumper insertion opening 8*a*, 8*b*, 8*c* is retained between the two retaining arms 14, 15. The contact element, which is preferably also U-shaped so that it can rest directly on the retaining arms 14, 15 and, in doing so, can be retained by the retaining arms 14, 15, is also arranged between these two retaining arms 14, 15.

In the embodiment shown here, each connection module 1*a*, 1*b*, 1*c* comprises three retaining elements 13*a*, 13*b*, 13*c*, the retaining elements 13*a*, 13*b*, 13*c* and, as a result, the jumper insertion openings 8*a*, 8*b*, 8*c* being formed on/in a substantially plate-shaped module insert 16*a*, 16*b*, 16*c*. The module inserts 16*a*, 16*b*, 16*c* are each inserted into an opening formed in the transverse side 6*a*, 6*b*, 6*c* of the housing 3*a*, 3*b*, 3*c*, the module inserts 16*a*, 16*b*, 16*c* being inserted before the two housing halves of the housing 3*a*, 3*b*, 3*c* are assembled.

Both the housing 3*a*, 3*b*, 3*c* as well as the retaining elements 13*a*, 13*b*, 13*c* and the module insert 16*a*, 16*b*, 16*c* are preferably made of an insulating material, such as a plastics material.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Connection module 1*a*, 1*b*, 1*c*
Mounting rail 2
Housing 3*a*, 3*b*, 3*c*
Housing base 4*a*, 4*b*, 4*c*
Housing upper surface 5*a*, 5*b*, 5*c*
Transverse side 6*a*, 6*b*, 6*c*
Jumper 7*a*, 7*b*, 7*c*
Jumper insertion opening 8*a*, 8*b*, 8*c*
Direction of insertion 9
Transverse axis 10
Longitudinal axis 11
Longitudinal axis 12
Retaining element 13*a*, 13*b*, 13*c*
Retaining arm 14
Retaining arm 15
Module insert 16*a*, 16*b*, 16*c*

The invention claimed is:

1. A connection module, comprising:

a housing having a housing base, a housing upper surface, and a transverse side extending from the housing base to the housing upper surface, the housing being configured to fix to a mounting rail via the housing base via a pivoting movement of the housing, the housing having a transverse axis perpendicular to the transverse side of the housing;

a plurality of connection elements disposed in the housing;

at least one jumper insertion opening for receiving a jumper, the at least one jumper insertion opening being disposed in the transverse side of the housing; and a contact element for forming an electrical contact with the jumper, the contact element being disposed in the jumper insertion opening;

wherein the jumper insertion opening extends in the direction of insertion of the jumper into the jumper insertion opening from the housing base towards the housing upper surface at an angle $\alpha$ of between 20 and 70 degrees to the transverse axis of the housing.

2. The connection module according to claim 1, herein the jumper insertion opening is disposed in an upper region of the transverse side of the housing, which region is disposed so as to be adjacent to the housing upper surface.

3. A connection module according to claim 1, wherein the jumper insertion opening is formed in a module insert, the module insert being inserted into an opening which is formed in the transverse side of the housing.

4. A connection module according to claim 1, wherein the juniper insertion opening is formed in a retaining element protruding from the transverse side of the housing.

* * * * *